US009682715B2

(12) United States Patent
Liu et al.

(10) Patent No.: US 9,682,715 B2
(45) Date of Patent: Jun. 20, 2017

(54) CARRIAGE BODY FOR MULTIPLE UNIT TRAIN

(71) Applicant: TANGSHAN RAILWAY VEHICLE CO., LTD., Tangshan (CN)

(72) Inventors: Lilei Liu, Tangshan (CN); Minqiao Hou, Tangshan (CN); Xiaogang Xu, Tangshan (CN)

(73) Assignee: CRRC TANGSHAN CO., LTD., Hebei (CN)

( * ) Notice: Subject to any disclaimer, the term of this patent is extended or adjusted under 35 U.S.C. 154(b) by 0 days.

(21) Appl. No.: 14/935,357

(22) Filed: Nov. 6, 2015

(65) Prior Publication Data

US 2016/0059869 A1 Mar. 3, 2016

Related U.S. Application Data

(63) Continuation of application No. PCT/CN2013/089194, filed on Dec. 12, 2013.

(30) Foreign Application Priority Data

May 8, 2013 (CN) ..... 2013 1 0166752

(51) Int. Cl.
*B61D 19/00* (2006.01)
*B61D 19/02* (2006.01)
(Continued)

(52) U.S. Cl.
CPC ..... *B61D 19/02* (2013.01); *B61D 1/00* (2013.01); *B61D 17/10* (2013.01)

(58) Field of Classification Search
CPC ..... B61D 19/02; B61D 1/00; B61D 17/00
See application file for complete search history.

(56) References Cited

U.S. PATENT DOCUMENTS 2,410,173 A * 10/1946 Lutherman ..... B61D 1/00 105/315
2,946,297 A * 7/1960 Dean ..... B61D 1/00 105/345

(Continued)

FOREIGN PATENT DOCUMENTS

CN 2808689 Y 8/2006
CN 201198311 Y 2/2009

(Continued)

OTHER PUBLICATIONS

International Search Report of corresponding International PCT application No. PCT/CN2013/089194, dated Mar. 27, 2014.

(Continued)

*Primary Examiner* — Jason C Smith
(74) *Attorney, Agent, or Firm* — J.C. Patents

(57) ABSTRACT

Disclosed is a carriage body for a multiple unit train, comprising: a chassis (10) and a power system module mounted in a suspended manner below the chassis (10), an access opening (11) for facilitating to overhaul the power system module is provided on the chassis (10), a passenger compartment floorboard (12) covers top surface of the chassis (10) and surround the access opening (11), further comprising an access door (2) for blocking the access opening (11), which comprises a top panel (21), a reinforcement panel (22), and a sound-insulation panel (23) for sound-proofing, which are provided successively from top to bottom, and are fixedly connected as one piece; the periphery of the top panel (21) engages with the passenger compartment floorboard (12); the top panel (21) is detachably yet fixedly connected onto the floorboard (12) of the passenger compartment and/or the chassis (10).

9 Claims, 7 Drawing Sheets

(51) Int. Cl.
*B61D 17/10* (2006.01)
*B61D 1/00* (2006.01)

(56) References Cited

U.S. PATENT DOCUMENTS

| | | | | |
|---|---|---|---|---|
| 3,759,566 | A * | 9/1973 | Sobey | B60V 3/04 105/341 |
| 2013/0180429 | A1* | 7/2013 | Schwiegel | B61D 17/10 105/413 |
| 2015/0016171 | A1* | 1/2015 | Yasuda | B61C 17/00 363/141 |
| 2015/0061380 | A1* | 3/2015 | Schomacker | B64C 1/18 307/9.1 |
| 2015/0210296 | A1* | 7/2015 | Arras | B61D 35/007 137/348 |
| 2015/0314794 | A1* | 11/2015 | Takahashi | B61D 17/18 105/397 |
| 2015/0367863 | A1* | 12/2015 | Hirashima | B61D 17/10 105/422 |
| 2016/0059869 | A1* | 3/2016 | Liu | B61D 17/10 105/343 |

FOREIGN PATENT DOCUMENTS

| | | | |
|---|---|---|---|
| CN | 101450642 | A | 6/2009 |
| CN | 102079337 | A | 6/2011 |
| CN | 201923145 | U | 8/2011 |
| CN | 202046316 | U | 11/2011 |
| CN | 202147729 | U | 2/2012 |
| CN | 103241255 | A | 8/2013 |
| DE | 226 525 | A1 | 8/1985 |
| JP | H08-85452 | A | 4/1996 |
| JP | 2011-126355 | A | 6/2011 |

OTHER PUBLICATIONS

Chinese First Examination Report of corresponding China patent application No. 201310166752.0, dated Feb. 3, 2015.

* cited by examiner

CARRIAGE BODY FOR MULTIPLE UNIT TRAIN

CROSS-REFERENCE TO RELATED APPLICATIONS

This application is a continuation of International Patent Application No. PCT/CN2013/089194, filed on Dec. 12, 2013, which claims priority to Chinese Patent Application No. 201310166752.0, filed on May 8, 2013, both of which are incorporated herein by reference in their entireties.

TECHNICAL FIELD

The present invention relates to the manufacturing technology of railway vehicle, and particularly to a carriage body for a multiple unit train.

BACKGROUND

The power system for an internal-combustion multiple unit train includes a diesel generator set, a charging set, an air and hydraulic oil cooling apparatus for diesel engine, an inlet air filter etc, which are integrated together and mounted on a common frame to form a power system module, and the power system module is mounted in a suspended manner below the chassis of the carriage body, so as to save space for passenger compartments.

Since it is necessary to frequently detect, maintain and replace parts of the power system, an access opening is provided on floorboard of a passenger compartment and chassis of the carriage body, to facilitate to overhaul the power system suspended under the chassis, and the access opening is covered by an access door, ensuring that a normal function of the passenger compartment for carrying passengers during operation would be affected.

In a carriage body of a railway vehicle in the prior art, the access door is generally a piece of plywood with a shape matched with the access opening, the upper surface of the plywood is fixedly covered with a floorboard cloth layer, and is also fixedly arranged with a handle, to facilitate to lift the access door and open the access opening. However, such an access door in form of a single-layer plywood has a poor structural strength, and is easily deformed, or even fractured when the passenger compartments are overloaded, and thus affecting the driving safety; besides, the sealing and sound-proofing properties are also poor, so that most of the noises caused during operating of the devices in the power system are transferred to the passenger compartments, and thus the passenger compartments become relatively noisy.

SUMMARY

In view of the defects in the prior art, the present invention provides a carriage body for a multiple unit train, achieving effective blocking for the access opening, and improving sealing and sound-proofing properties as well as bearing strength of the access door.

The present invention provides a carriage body for a multiple unit train, including: a chassis and a power system module mounted in a suspended manner below the chassis; the chassis is provided with an access opening for facilitating to overhaul the power system module, and a floorboard of a passenger compartment covers a top surface of the chassis and surrounds the access opening, and further including an access door for blocking the access opening, the access door includes a top panel, a reinforcement panel and a sound-insulation panel for sound-proofing, provided successively from top to bottom, the top panel, the reinforcement panel and the sound-insulation panel are fixedly connected as one piece; the periphery of the top panel engages with the floorboard of the passenger compartment; and the top panel is detachably yet fixedly connected onto the floorboard of the passenger compartment and/or the chassis.

In the carriage body for a multiple unit train according to in the present invention, the reinforcement panel and the sound-insulation panel are provided in the access door, not only can the access opening be conveniently opened during maintenance, and reliably blocked during normal operation, but also the bearing strength of the access door is improved, thus avoiding deformation or fracture when the passenger compartments are overloaded, the safety, sealing, and sound-proofing effects are good, and noise transmitted from the power system module to the passenger compartments can be effectively reduced.

DESCRIPTION OF EMBODIMENTS

Figure 1:
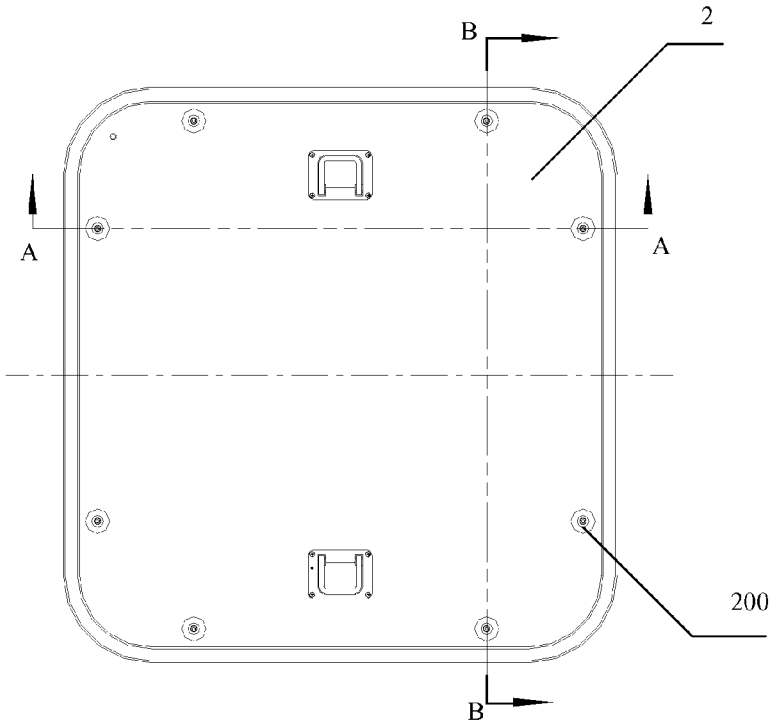
FIG. 1 is a top view of an access door of a carriage body for a multiple unit train according to an embodiment of the present invention.
Figure 2:
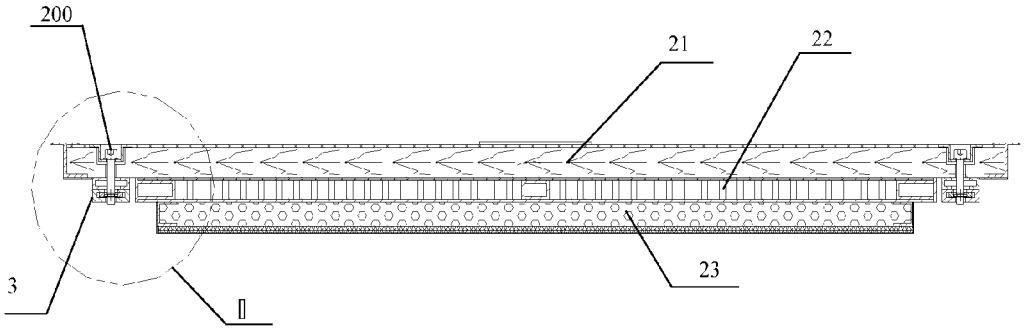
FIG. 2 is a sectional view of FIG. 1 along A-A line.
Figure 3:
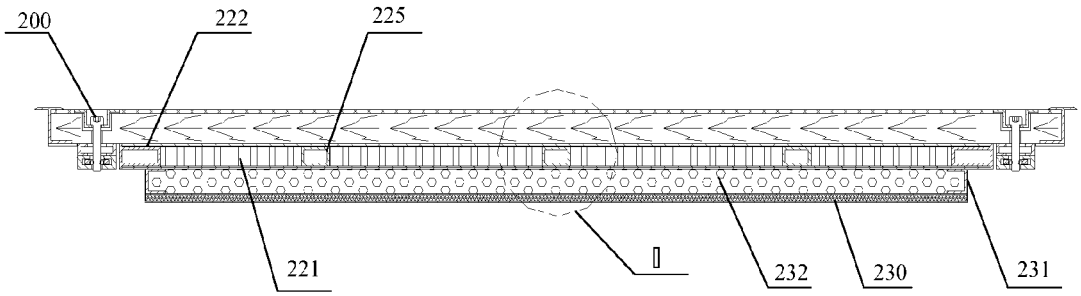
FIG. 3 is a sectional view of FIG. 1 along B-B line.
Figure 4:
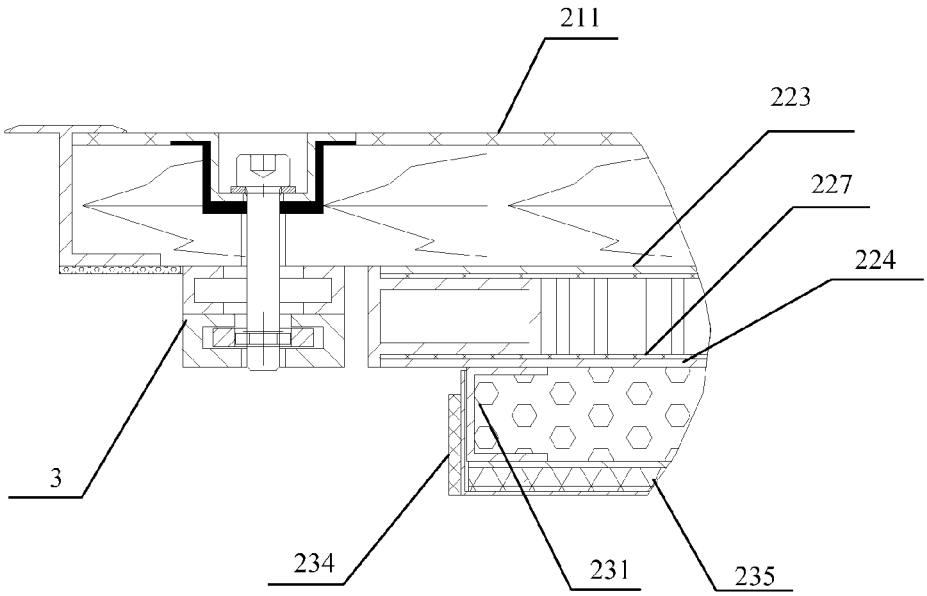
FIG. 4 is an enlarged view of FIG. 2 at I.
Figure 5:
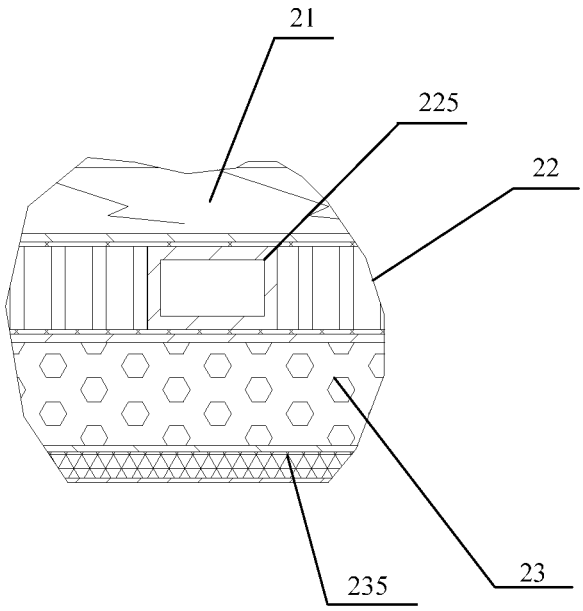
FIG. 5 is an enlarged view of FIG. 3 at II.
Figure 6:
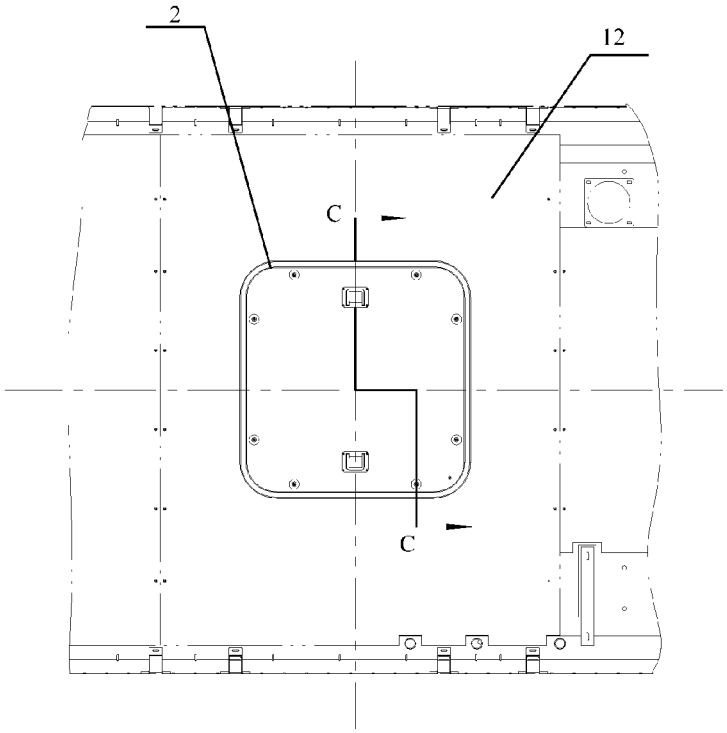
FIG. 6 is a top view of a floorboard of a passenger compartment of a carriage body for a multiple unit train according to an embodiment of the present invention.
Figure 7:
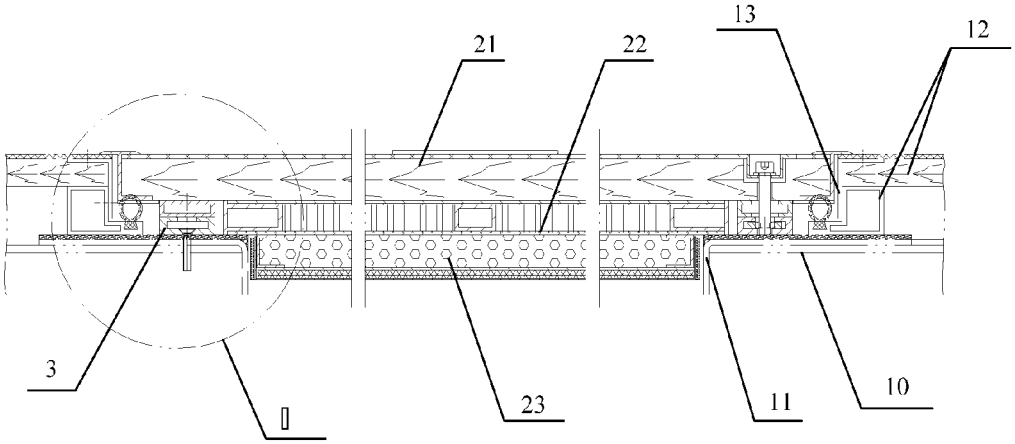
FIG. 7 is a sectional view of FIG. 6 along C-C line.
Figure 8:
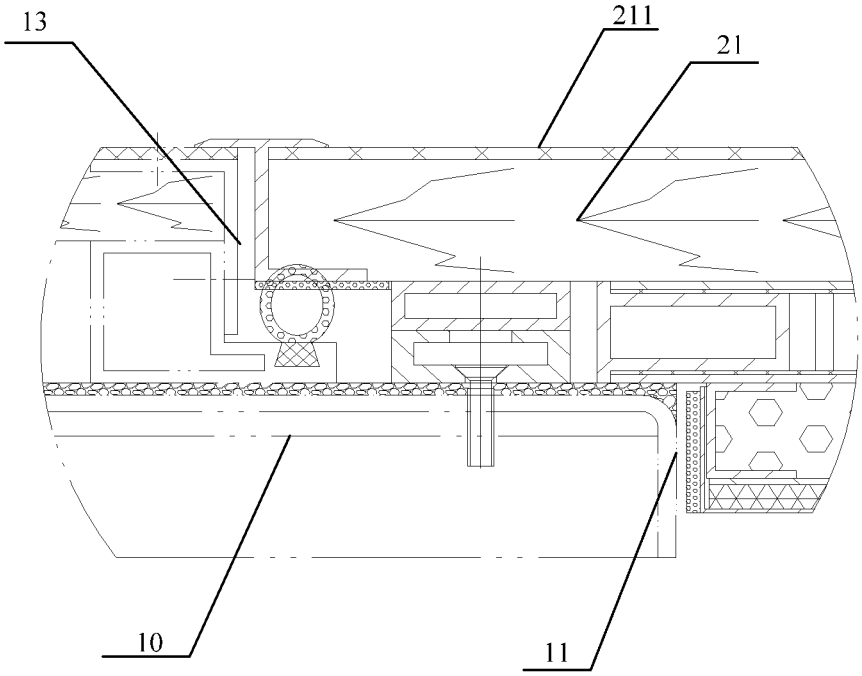
FIG. 8 is an enlarged view of FIG. 7 at III.

FIG. 1 is a top view of an access door of a carriage body for a multiple unit train according to an embodiment of the present invention; FIG. 2 is a sectional view of FIG. 1 along A-A line; FIG. 3 is a sectional view of FIG. 1 along B-B line; FIG. 4 is an enlarged view of FIG. 2 at I; FIG. 5 is an enlarged view of FIG. 3 at II; FIG. 6 is a top view of a floorboard of a passenger compartment of a carriage body for a multiple unit train according to an embodiment of the present invention; FIG. 7 is a sectional view of FIG. 6 along C-C line; and FIG. 8 is an enlarged view of FIG. 7 at III; please refer to FIG. 1 to FIG. 8, a carriage body for a multiple unit train is provided in this embodiment, including: a chassis 10 and a power system module (not shown) mounted in a suspended manner below the chassis 10, wherein an access opening 11 for facilitating to overhaul the power system module is provided on the chassis 10, and a floorboard 12 of the passenger compartment covers a top surface of the chassis 10 and surrounds the access opening 11, and further including an access door 2 used for blocking the access opening 11, the access door 2 including a top panel 21, a reinforcement panel 22, and a sound-insulation panel 23 for sound-proofing, which are provided successively from top to bottom, the top panel 21, the reinforcement panel 22 and the sound-insulation panel 23 being fixedly connected as one piece; the periphery of the top panel 21 engages with the floorboard 12 of the passenger compartment; and the top panel 21 is detachably yet fixedly connected onto the chassis 10 and/or the floorboard 12 of the passenger compartment.

In particular, the carriage body for a multiple unit train can include a chassis 10, a side wall and an end wall fixedly arranged on the chassis 10, and a top panel covering the top of the side wall and the end wall, the chassis 10, the side walls at both sides, the front and rear end walls, and the top panel together enclose a passenger compartment space for holding passengers; the chassis 10 is provided on a bogie to drive the carriage body to run via the bogie. The power system module in this embodiment refers to all devices of the power system integrated on the common frame (such as a diesel generator set, a charging set, an air and hydraulic oil cooling apparatus for diesel engine), for supplying power to the multiple unit train; the power system module is fixedly mounted in a suspended manner below the chassis, so as to save inner space for passenger compartments.

In order to facilitate to overhaul and detect the power system module as well as replace devices, the chassis 10 is provided with an access opening 11, the floorboard 12 of the passenger compartment is laid on the upper surface of the chassis 10, that is, the floorboard 12 of the passenger compartment is also provided with a mounting opening 13 corresponding to the access opening 11, of course, the mounting opening 13 can surround the periphery of the access opening 11, and also can just be aligned with the access opening 11, for example, when both the access opening 11 and the mounting opening 13 are rectangular, the access opening 11 can correspond to the area surrounded by the mounting opening 13, or the access opening 11 and the mounting opening 13 have the same size and exactly overlap with each other.

The top panel 21 can be a panel made of wooden material or other panel made of the same material with the floorboard 12 of the passenger compartment, the reinforcement panel 22 can be a composite structure frame such as honeycomb panel or other metal panel, so as to provide better intensity and rigidity, the sound-insulation panel can be a panel made of common sound-insulation or sound-absorption materials; a composite structure is also possible, for example, the sound-insulation panel can include a metal frame with sound-absorption or sound-insulation materials filled therein, so that sound wave propagation can be hindered via the sound-insulation panel, and sound-insulation function works; the access door 2 can be a panel shaped door, the top panel 21 is arranged at the top layer, the sound-insulation panel 23 is arranged at the bottom layer, and the reinforcement panel 22 is arranged between the top panel 21 and the sound-insulation panel 23; the top panel 21 and the reinforcement panel 22, the reinforcement panel 22 and the sound-insulation panel 23 are fixed together respectively by means of mechanical fastening, press bonding or adhesive bonding, moreover, the top panel 21, the reinforcement panel 22 and the sound-insulation panel 23 can be equal in size and are center-aligned, alternatively, the top panel 21 can be larger than the reinforcement panel 22, the reinforcement panel 22 can be larger than the sound-insulation panel 23, and meanwhile, the top panel 21, the reinforcement panel 22 and the sound-insulation panel 23 are center-aligned, besides, the periphery of the top panel 21 engages with the floorboard 12 of the passenger compartment, that is, edges of the top panel 21 extend to the mounting opening 13 formed on the floorboard 12 of the passenger compartment, so that there is no gap between the top panel 21 and the floorboard 12 of the passenger compartment; preferably, the top panel 21 can be in contact with the floorboard 12 of the passenger compartment via a rubber sealing ring for a better sealing, so as to improve sound-insulation and noise reduction effects.

Figure 9:
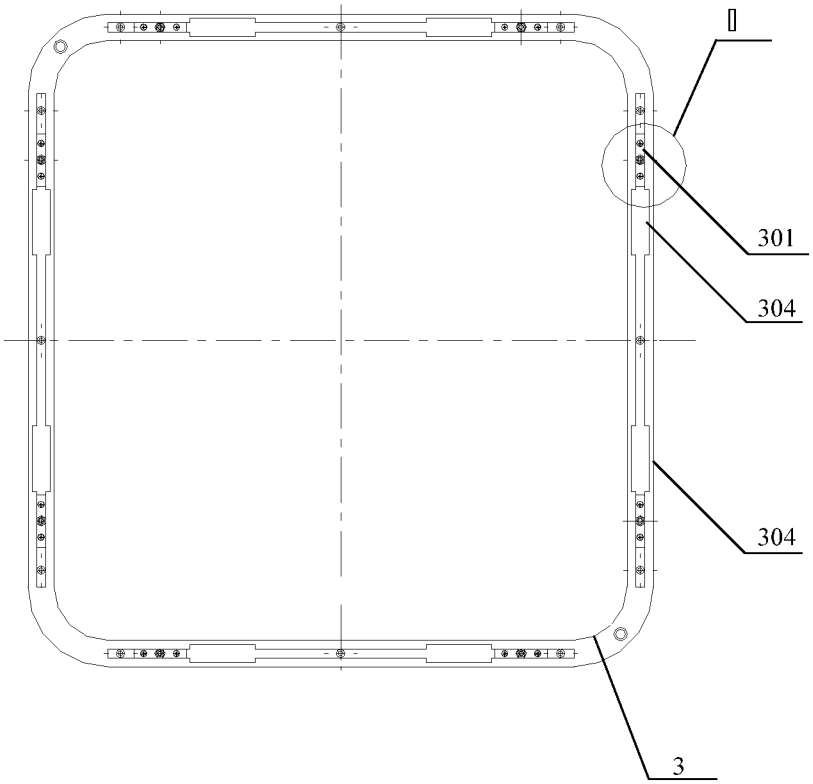
FIG. 9 is a top view of a door base of FIG. 6.
Figure 10:
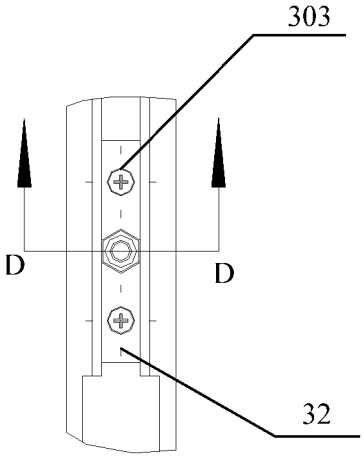
FIG. 10 is an enlarged view of FIG. 9 at IV.

In particular, the top panel 21 is detachably connected to the passenger compartment 12 and/or the chassis 10 via bolting by bolts or screws 200, which means that a fastening nut is fixedly embedded in the floorboard of the passenger compartment, and the bolt or the screw is fastened to the fastening nut after successively penetrating through the top panel 21, the reinforcement panel 22, and the sound-insulation panel 23; alternatively, the fastening nut can be fixedly arranged on the chassis 10 below the floorboard 12 of the passenger compartment, then the bolt or the screw 200 is fastened to a nut-fixing block 32 (as shown in FIG. 9 and FIG. 10) on the chassis 10 after successively penetrating through the top panel 21, the reinforcement panel 22, the sound-insulation panel 23 and the floorboard 12 of the passenger compartment. The nut-fixing block 32 (as shown in FIG. 9 and FIG. 10) can include a cube fixed on the chassis 10 by welding and a nut embedded in the cube, the central threaded hole of the nut can be used for a threaded connection with the above bolt or the screw 200; of course, the nut-fixing block 32 (as shown in FIG. 9 and FIG. 10) also can be a hexagon nut. In addition, there may be multiple bolts or nuts 200, which can be distributed near each vertex angle of the rectangular access door 2. When the power system module needs to be overhauled, the bolt or the screw is removed, then the access door 2 is easy to be detached and the access opening 11 is exposed.

When the mounting opening 13 on the floorboard 12 of the passenger compartment is larger than the access opening 11, the mounting opening 13 surrounds the access opening 11, that is, a projection of the mounting opening 13 falls within a plane where the access opening 11 is located, in this way, the structure of the access door 2 is preferably: an area thereof from the top panel 21 to the sound-insulation panel 23 can be reduced successively, so that the top panel 21 is engaged with the mounting opening 13, the top surface of the top panel 21 is flush with the top surface of the floorboard 12 of the passenger compartment, and meanwhile, the sound-insulation panel 23 can stretch into the access opening 11 and being engaged with the access opening 11; accordingly, the access opening 11 can be well-sealed during normal operation, and will not affect normal walking of the passenger within the passenger compartment.

In the carriage body for a multiple unit train provided in this embodiment, the reinforcement panel and the sound-insulation panel are provided in the access door, not only can the access opening be conveniently opened during maintenance, and reliably blocked during normal operation, but also the bearing strength of the access door is improved, thus avoiding deformation or fracture when the passenger compartments are overloaded, the safety, sealing, and sound-proofing effects are good, and noise transmitted from the power system module to the passenger compartments can be effectively reduced.

Further, the sound-insulation panel 23 can include a rigid substrate 230, a first rigid frame 231 fixedly arranged around the rigid substrate 230 and matched with the access opening 11, and sound-absorption or sound-insulation material 232 filled between the rigid substrate 230 and the first rigid frame 231. That is, the rigid substrate 230 can be a metallic panel (such as an aluminum panel) having the same shape with the sound-insulation panel, the first rigid frame 231 is a frame with a certain thickness and being fixedly arranged on the edge of the rigid substrate 230, the height of the first rigid frame 231 can be the thickness of the rigid substrate 23, and the sound-absorption or sound-insulation material 232 can be laid on the rigid substrate 230, and within an area surrounded by the first rigid frame 231. Particularly, the sound-insulation material 232 can be polyurethane foams having a good sound-absorption function, and the noise reduction coefficient thereof can be above 0.65.

Furthermore, the reinforcement panel 22 can include an aluminum honeycomb panel 221 and a second rigid frame 222 fixedly arranged around the aluminum honeycomb panel 221, particularly, the aluminum honeycomb panel 221 can be a panel made of aluminum honeycomb materials, and the columnar honeycomb core therein extends in the thickness direction of the panel, so as to improve the vertical bearing capability; the second rigid frame 222 can surround the aluminum honeycomb panel and being fixed together with the lateral surface of the aluminum honeycomb panel.

The above reinforcement panel 22 also can include a first aluminum panel 223 and a second aluminum panel 224 respectively covering the top surface and the bottom surface of the aluminum honeycomb panel 221, and edges of the first aluminum panel 223 and the second aluminum panel 224 are fixedly connected with the second rigid frame 222 respectively; the second rigid frame 222 also include at least one reinforcing rib 225 penetrating through the aluminum honeycomb panel 221 and being arranged between the first aluminum panel 223 and the second aluminum panel 224. Particularly, in order to further improve intensity and rigidity of the reinforcement panel 22, the second rigid frame 222 also can include multiple reinforcing ribs 225 extending in a plane where the second rigid frame 222 is located, the multiple reinforcing ribs 225 can be parallel with or perpendicular to each other; correspondingly, the aluminum honeycomb panel 221 can consist of multiple sub-panels, which can be respectively fixedly filled in the second rigid frame 222 within an area surrounded by the reinforcing ribs 225; such a combined structure with reinforcing ribs 225 penetrating through the aluminum honeycomb panel 221 can further improve intensity and rigidity of the reinforcement panel 22. Of course, a sound-proofing rubber plate 227 also can be arranged between the first aluminum panel 223 and the aluminum honeycomb panel 221, and between the second aluminum panel 224 and the aluminum honeycomb panel 221, respectively, so as to improve the sound-proofing capability of the whole access panel.

Preferably, a fire-proofing expansion bar 234 also can be fixedly arranged around lateral surface of the sound-insulation panel 23; the bottom surface of the sound-insulation panel 23 is also fixedly arranged with a thermal insulation material layer 235; in particular, the fire-proofing expansion bar 234, which has good fire-proofing, sealing and smoke blocking functions, can be bonded onto an outer side surface of the first rigid frame of the sound-insulation panel 23; in the event of fire, the graphite in the fire-proofing expansion bar 234 will expand and the volume thereof will increase to 8-10 times of the original volume, thereby being effectively sealed and isolated from the fire source, and avoiding entrance of poisonous gas and smog into the passenger compartment.

Figure 11:
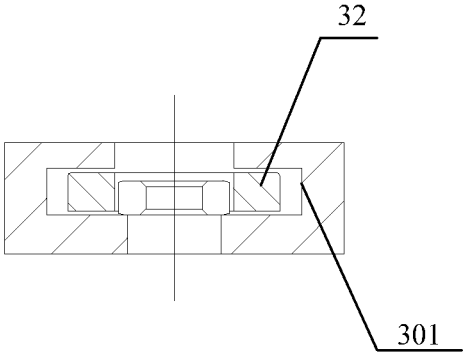
FIG. 11 is a sectional view of FIG. 9 along D-D line.

On the other hand, as shown from FIG. 9 to FIG. 11, in order to facilitate to support and mount the access door 2, a door base 3 is further fixedly arranged on the chassis and around the access opening 11, the door base 3 can be a frame with its shape and size matched with the access door 2, for example, when the access door is rectangular, the door base 3 can be a rectangular with the same shape of the contour of the access door; the door base 3 can be fixed to a top surface of the chassis 10 via a screw; the top surface of the door base 3 is provided with a sliding groove 301, the nut-fixing block 32 can slide within the sliding groove 301 relative to the length direction of the sliding groove 301; the nut-fixing block 32 is mounted in a sliding manner in the sliding groove 301, and is fixed relative to the door base 3 via a locating pin 303 penetrating through the nut-fixing block 32. Particularly, the top surface of the door base 3 is provided with an elongate sliding groove 301, and the sliding groove 301 can include a first groove section with the width of its top opening smaller than the width of the nut-fixing block 32, and a second groove section 304 with the width of its top opening larger than the width of the nut-fixing block 32, when mounting the nut-fixing block 32, the nut-fixing block 32 can be placed into the sliding groove 301 via the second groove section 304, and pushed to the first groove section along the length direction, since the width of the top opening of the first groove is smaller than the width of the nut-fixing block, then the nut-fixing block 32 can be fixed in vertical direction, and can be located in the horizontal plane by connecting the locating pin 303 penetrating through the nut-fixing block 32 to the groove bottom of the sliding groove 301 (the top surface of the chassis 10 is taken as a horizontal plane). Such a mounting structure of the nut-fixing block not only facilitates the mounting operation, but is also easy to replace the nut-fixing block 32 depending on the models of the bolt or screw, when the bolts or screws of different models are provided with different nut-fixing blocks 32, so as to improve adaptability of the door base.

Further, please refer to FIG. 7 and FIG. 8, for the existing carriage body for a multiple unit train with a floorboard 12 of passenger compartment of plywood in combination with floorboard cloth, the top panel 21 can include a plywood and a floorboard cloth 211 fixedly covering the top surface of the plywood, and the top surface of the floorboard cloth 211 is flush with the top surface of the floorboard 12 of the passenger compartment; that is, the top panel 21 can adopt the plywood with the floorboard cloth 211 fixedly covering thereon, and the floorboard cloth at the top layer of the floorboard 12 of the passenger compartment is flush with the floorboard cloth 211 at the top layer of the top panel 21, which can avoid affecting walking due to unevenness.

Finally, it should be noted that the above embodiments are merely provided for describing the technical solutions of the present invention, but not intended to limit the present invention. It should be understood by persons skilled in the art that although the present invention has been described in detail with reference to the foregoing embodiments, modifications can be made to the technical solutions described in the foregoing embodiments, or equivalent replacements can be made to partial or all technical features in the technical solutions; however, such modifications or replacements do not cause the essence of corresponding technical solutions to depart from the scope of the embodiments of the present invention.

What is claimed is:

1. A carriage body for a multiple unit train, comprising: a chassis and a power system module mounted in a suspended manner below the chassis; wherein the chassis is provided with an access opening for facilitating overhaul of the power system module, and a floorboard of a passenger compartment covers a top surface of the chassis and surrounds the access opening, and further comprising an access door for blocking the access opening, wherein the access door comprises a top panel, a reinforcement panel and a sound-insulation panel for sound-proofing, provided successively from top to bottom, the top panel, the reinforcement panel and the sound-insulation panel are fixedly connected as one piece; the periphery of the top panel is engaged with the floorboard of the passenger compartment; and the top panel is detachably or fixedly connected to the floorboard of the passenger compartment and/or the chassis.

2. The carriage body for a multiple unit train according to claim 1, wherein the floorboard of the passenger compartment is provided with a mounting opening surrounding the access opening, the top panel is engaged with the mounting opening of the floorboard of the passenger compartment, the top surface of the top panel is flush with the top surface of the floorboard of the passenger compartment; the sound-insulation panel is engaged with the access opening.

3. The carriage body for a multiple unit train according to claim 1, wherein the top panel is bolted to a nut-fixing block on the chassis via at least two bolts or screws.

4. The carriage body for a multiple unit train according to claim 3, wherein, a door base is further fixedly arranged on the chassis and around the access opening, a top surface of the door base is provided with a sliding groove, the nut-fixing block is mounted in a sliding manner in the sliding groove, and is fixed relative to the door base via a locating pin penetrating through the nut-fixing block; the bolt or screw is bolted to the nut-fixing block after penetrating through the access door.

5. The carriage body for a multiple unit train according to claim 1, wherein, the sound-insulation panel comprises a rigid substrate, a first rigid frame fixedly arranged around the rigid substrate and matched with the access opening, and sound-absorption or sound-insulation material filled between the rigid substrate and the first rigid frame.

6. The carriage body for a multiple unit train according to claim 5, wherein, the top panel comprises a plywood and a floorboard cloth fixedly covering the top surface of the plywood, and the top surface of the floorboard cloth is flush with the top surface of the floorboard of the passenger compartment.

7. The carriage body for a multiple unit train according to claim 1, wherein, the reinforcement panel comprises an aluminum honeycomb panel and a second rigid frame fixedly arranged around the aluminum honeycomb panel.

8. The carriage body for a multiple unit train according to claim 7, wherein, the reinforcement panel further comprises a first aluminum panel and a second aluminum panel respectively covering the top surface and the bottom surface of the aluminum honeycomb panel, and edges of the first aluminum panel and the second aluminum panel are fixedly connected with the second rigid frame respectively; the second rigid frame further comprises at least one reinforcing rib penetrating through the aluminum honeycomb panel and being arranged between the first aluminum panel and the second aluminum panel.

9. The carriage body for a multiple unit train according to claim 1, wherein, a fire-proofing expansion bar is fixedly arranged around lateral surface of the sound-insulation panel; the bottom face of the sound-insulation panel is fixedly arranged with a thermal insulation material layer.

* * * * *